US011331233B1

(12) United States Patent
Rodriguez

(10) Patent No.: US 11,331,233 B1
(45) Date of Patent: May 17, 2022

(54) PATIENT TURNING DEVICE WITH REMOVABLE WINDOWS

(71) Applicant: Taina Rodriguez, West New York, NJ (US)

(72) Inventor: Taina Rodriguez, West New York, NJ (US)

( * ) Notice: Subject to any disclaimer, the term of this patent is extended or adjusted under 35 U.S.C. 154(b) by 151 days.

(21) Appl. No.: 16/732,411

(22) Filed: Jan. 2, 2020

(51) Int. Cl.
*A61G 7/00* (2006.01)
*A61G 7/10* (2006.01)

(52) U.S. Cl.
CPC ..... *A61G 7/001* (2013.01); *A61G 7/1023* (2013.01)

(58) Field of Classification Search
CPC .... A61G 7/001; A61G 7/1023; A61G 7/1026; A61G 7/1025; A61G 7/1051; A61G 7/1007; A61G 7/1059; A61G 1/044; A61G 1/048
USPC ..... 5/81.1 T
See application file for complete search history.

(56) References Cited

U.S. PATENT DOCUMENTS 2,508,795 A * 5/1950 Nielsen ..... A47C 31/08 294/152
2,665,432 A * 1/1954 Butler ..... A61G 7/1046 5/88.1
4,872,226 A * 10/1989 Lonardo ..... A61G 7/1023 5/89.1
5,562,707 A * 10/1996 Prochazka ..... A61N 1/05 607/2
6,508,389 B1 * 1/2003 Ripoyla ..... A45F 3/14 224/262
7,225,484 B1 * 6/2007 Ortiz ..... A47D 15/008 5/655
8,281,430 B1 * 10/2012 Hough ..... A61G 7/1051 5/89.1
8,959,682 B2 * 2/2015 Jenson ..... A61G 1/013 5/89.1
9,610,204 B1 * 4/2017 Steinbock ..... A61G 1/01
9,849,053 B2 * 12/2017 Rigoni ..... A61G 7/1028
2002/0029417 A1 * 3/2002 Walker ..... A61G 7/1023 5/81.1 R
2006/0137693 A1 * 6/2006 Lewis ..... A61B 46/00 128/853
2015/0059767 A1 * 3/2015 Masucci ..... A61G 7/1023 128/849
2016/0338894 A1 * 11/2016 Rodriguez ..... A61G 7/1063
2016/0374883 A1 * 12/2016 Galbraith ..... A61G 7/1073 5/81.1 T (Continued)

*Primary Examiner* — David R Hare
*Assistant Examiner* — Luke Hall
(74) *Attorney, Agent, or Firm* — Michael J. Feigin, Esq.; Feigin and Fridman LLC

(57) ABSTRACT

A patient turning device attaches to side rails of a bed on one end in at least two spaced apart locations. Straps of the device are then placed under a patient and/or patient is placed on top of such straps. Between two of the straps are connecting straps extending perpendicular thereto, such as where the first straps are horizontal and the connecting straps are vertical. Connected to some of the vertical and/or horizontal straps are removable windows which are material which fills in at least some of the area between the first straps, connects to at least some of the connecting straps, and are removably and replacably connected to cover (fill in) some of this area between the straps. This allows for access to a patient's back after rotating the patient, in embodiments of the disclosed technology.

17 Claims, 7 Drawing Sheets

(56) References Cited

U.S. PATENT DOCUMENTS

| | | | | |
|---|---|---|---|---|
| 2017/0151112 | A1* | 6/2017 | Fletcher | A61G 7/1026 |
| 2018/0161607 | A1* | 6/2018 | Jacob | A62B 35/0037 |

* cited by examiner

PATIENT TURNING DEVICE WITH REMOVABLE WINDOWS

FIELD OF THE DISCLOSED TECHNOLOGY

The disclosed technology relates generally to devices for patient care, and, more specifically, to a device to maneuver a patient in a hospital bed.

BACKGROUND

Maneuvering hospital patients in bed, especially those who are paralyzed, immobile, or obese, presents a challenge to caregivers. A patient's inability to move or turn in bed impedes the patient's care. For instance, hospital staff may have difficulty in accessing areas of the patient's body where it is necessary to administer treatment or tests, conduct inspections, or perform hygienic tasks. As a result, several hospital staff members are frequently required to physically lift, turn, or move the bedridden patient, to a certain position and hold the patient stable in that posture, so that the required action may be completed. Hospital staff are often over-worked and have numerous urgent tasks to handle within a limited period of time. Therefore, the diversion of personnel to assist in maneuvering a patient in bed for routine care is a wasteful and inefficient use of limited and valuable hospital resources.

Other patient-maneuvering devices are available in the market. For instance, Walker U.S. Pat. No. 6,560,793, discloses a device in which the patient is laid on a sheet with side sleeves through which poles are inserted. The sleeves contain a portal through which the pole can be grasped for one-handed movement of a patent. Two detachable lateral straps are connected to the sheet. The ends of the straps have connectors that enable the straps to be attached to a bed rail. Once a patient is moved to the desired position, the sheet can be detached from the straps and patient care rendered while the straps hold the patient in position. Walker relies on two straps and a sheet which covers the patient's body. This prevents patient care to those areas. Thus, if the patient has a wound, surgical incision, burn, catheter tube or other medical device in a particular area of his or her torso, the sheet contacts that area; this may cause pain, further injury, or dislodgement of the medical device. These issues preclude the use of the Walker invention in many cases.

What is needed in the art is a way for the medical staff to safely and securely maneuver and position a patient in bed with minimum exertion. What is further needed is a way to turn a patient while allowing extensive access to the patient's body for the rendering of care. This should ideally be accomplished without negatively affecting a patient's wounds, surgical incisions, and/or attached medical devices.

SUMMARY OF THE DISCLOSED TECHNOLOGY

A patient rotating device of embodiments of the disclosed technology includes parallel straps, such as two parallel straps or more than two parallel straps. Each end of each strap terminates at an end connector. A rectangular middle section between at least two or all of the straps has at least one removable and re-attachable window or multiple removable and re-attachable windows inline with each other. The connector of each end of each strap extends further than the rectangular middle section in the straps most elongated direction. That is, the end connectors are outside of a region of straps which connect to the rectangular middle section.

When geometric directions and descriptions are given, such as "parallel", "rectangular" and as such they can be based on the exact mathematical definition, based on what a user would view as such (e.g. substantially as such), and/or be based on when the device is laid flat and evenly across a flat surface, though the device is moved and twisted/turned in use.

There can be two windows which are parallel to each other (non-overlapping but adjacent (touching or substantially touching along one edge)). The rectangular connector is bifurcated by a middle strap extending in parallel with the two parallel straps in embodiments of the disclosed technology. The rectangular connector then, in some such embodiments, has a side which is covered in hook and loop fastening material and each window can be covered by a removable panel filling in the window and having hook and loop fastener in a rectangular shape around edges thereof on a most elongated planar side. In this manner, the rectangular panels can be connected or removed from the middle rectangular section.

The rectangle hook and loop fastener of each removable panel corresponds in shape, size, and (relative) position to substantially half of the hook and loop fastener of the rectangular connector. This is defined as rectangular-shaped hook and loop fasteners of the rectangular middle section being designed to fit one or two panels, the two panels side by side and the hook and loop fastener (colloquially known as "velcro") being lined up to connect the panel and middle sections together.

Each end connector ends at an extreme end of a most flat longitudinal side (outer side with a largest area) of a respective parallel strap of the two parallel straps. Such end connectors can include hook and loop fastening material adapted to removably connect to another end connector at an opposite extreme end of a same respective parallel strap. A plurality of hooks extending generally transverse to a most elongated direction of the two parallel straps can be used to help pull the the straps. This can be done by attaching a rope to one of the hooks and pulling towards, for example a bed rail to turn a patient sideways.

A method of using the device(s) described above is carried out by connecting the two parallel straps to a bed rail via a first end connector of each strap. An object, e.g. a human being (person) is laid on the parallel straps and rectangular middle section at a same time. A second connector of each of the end connectors is pulled closer to the bed rail until the object/person is turned 90 degrees. The second connector of each strap is then connected to the bed rail or another bed rail on a same side of the bed. One can then partially remove or fully remove on or multiple panels, as needed, to access a back of the turned object/person.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A patient turning device attaches to side rails of a bed on one end in at least two spaced apart locations. Straps of the device are then placed under a patient and/or patient is placed on top of such straps. Between two of the straps are connecting straps extending perpendicular thereto, such as where the first straps are horizontal and the connecting straps are vertical. Connected to some of the vertical and/or horizontal straps are removable windows which are material which fills in at least some of the area between the first straps, connects to at least some of the connecting straps, and are removably and replacably connected to cover (fill in) some of this area between the straps. This allows for access to a patient's back after rotating the patient, in embodiments of the disclosed technology.

Embodiments of the disclosed technology will become more clear in view of the following description of the figures.

Figure 1:
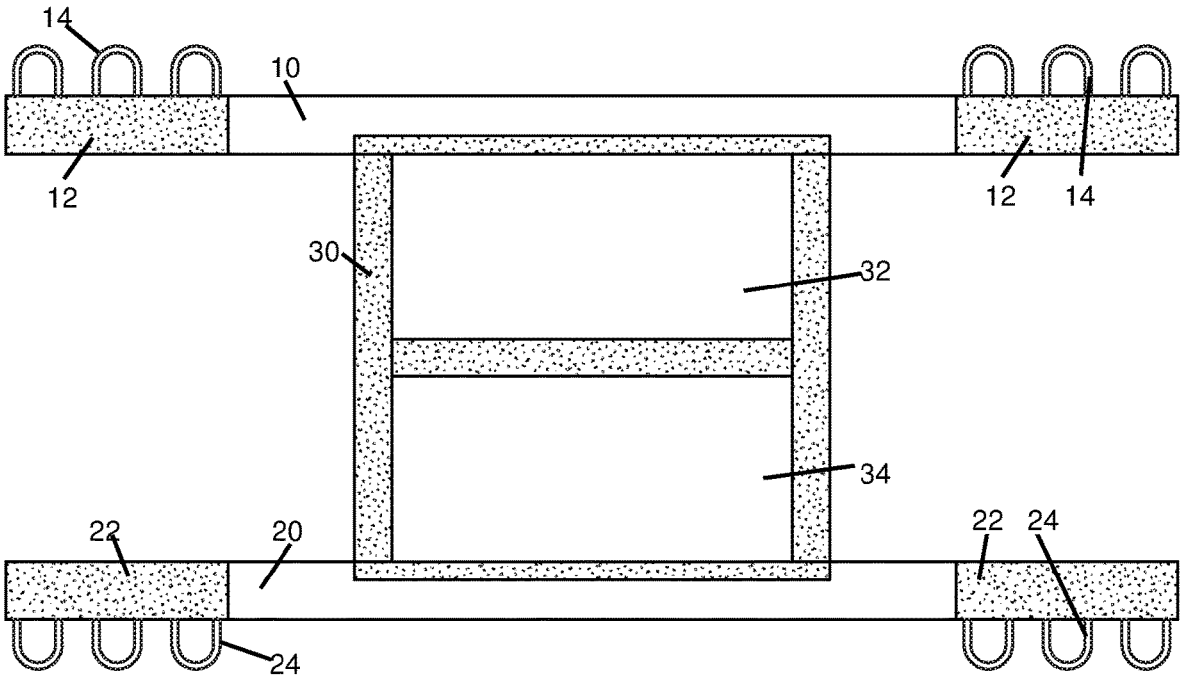
FIG. 1 shows a plan view of a patient rotating device of an embodiment of the disclosed technology.
Figure 3:
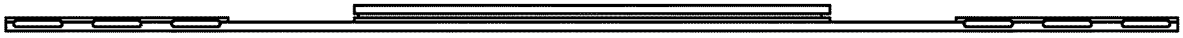
FIG. 3 shows a side view of the patient rotating device of FIG. 1.
Figure 4:
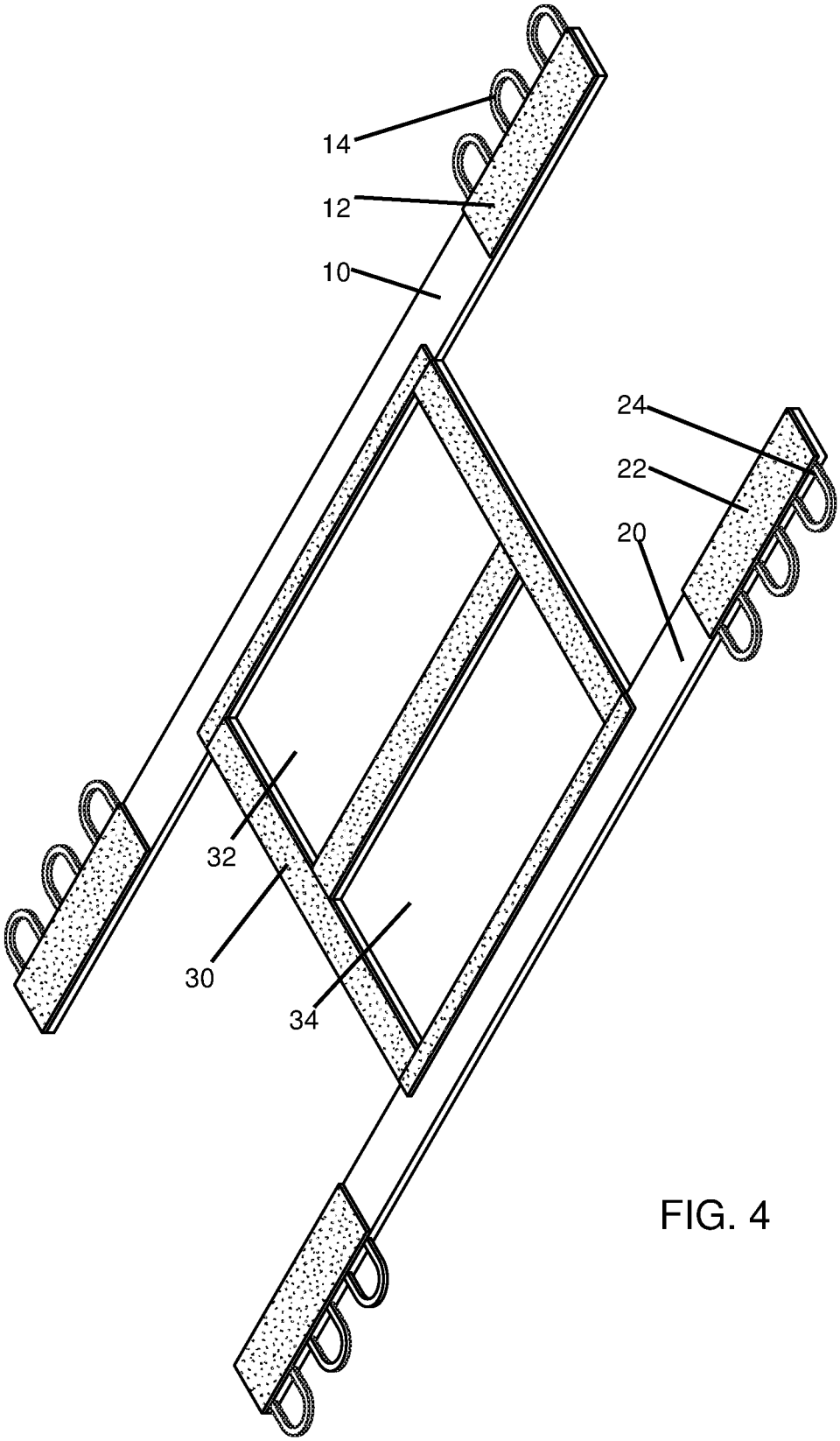
FIG. 4 shows a perspective view of the patient rotating device of FIG. 1.

FIG. 1 shows a plan view of a patient rotating device of an embodiment of the disclosed technology. FIG. 3 shows a side view of the patient rotating device of FIG. 1. FIG. 4 shows a perspective view of the patient rotating device of FIG. 1. Two horizontal straps 10 and 20 are connected by vertical straps which make up a rectangular middle section 30. The rectangular middle section 30 has within it two removable panels 32 and 34 which can be repeatedly (at least 100 times) removed and reattached to open portals or windows which are covered, uncovered, or partially uncovered as the panels/windows are removed. The straps 10 and 20, which for purposes of convenience, are also referred to as "horizontal straps" due to their typical extension with respect to their use with a person lying there-over who is "vertical" in comparison and/or with respect to a most elongated length of a bed the device is used on.

The straps 10 and 20 have connectors on either end which are adapted to connect the ends of each strap to itself. Thus, the connectors 12 of the first horizontal strap 10 connects to connectors 12 at an opposite end of the same strap, such as by way of a hook and loop fasteners, snaps, buttons, ties, buckle, or the like. Further connectors can include hooks 14 which extend transverse to a most elongated direction or largest flat side of the horizontal strap 10. The hooks can be used to attach to another hook on an opposite side of a respective strap or be used to attach a rope or other device to add torque, temporary extension of length, and/or easier ability to pull the horizontal strap 10. Elements of the first horizontal strap 10 are incremented 10 when shown with respect to the second horizontal strap 20. This includes the connector region 22 with connector and hooks 24. Note also that connector region extends to an extreme end of a respective horizontal strap 10 or 20 which is an edge where a most elongated and generally flat side of a strap meets another side of the device or otherwise terminates at a narrow side thereof.

Figure 2:
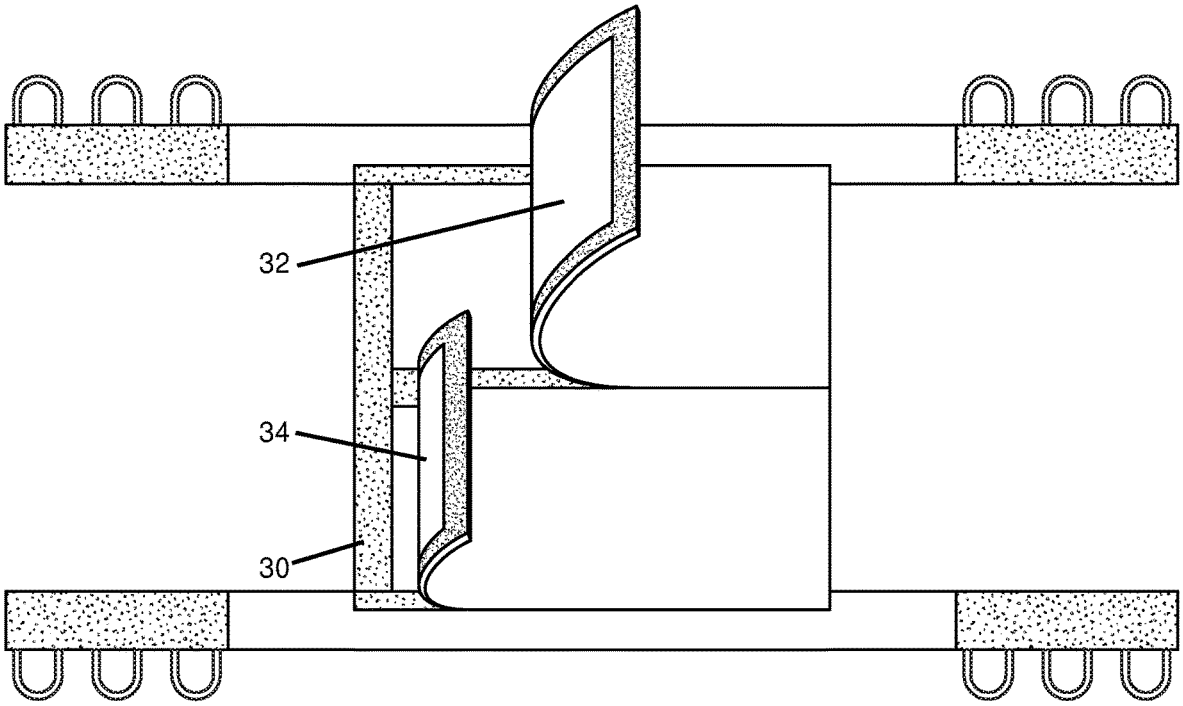
FIG. 2 shows the patient rotating device of FIG. 1 with removable and re-attachable windows being removed from the device.
Figure 5:
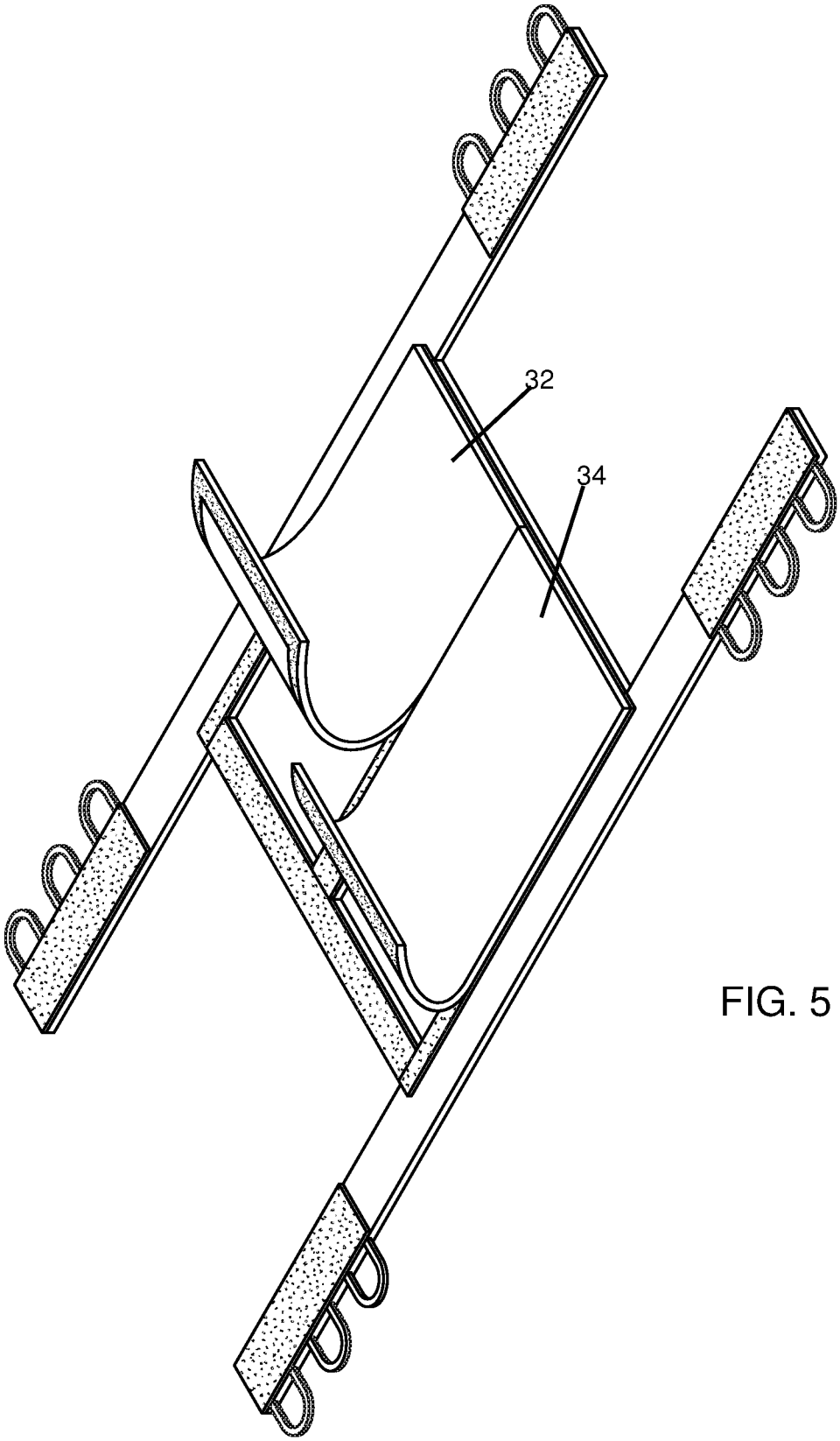
FIG. 5 shows a perspective view of the patient rotating device of FIG. 2.

FIG. 2 shows the patient rotating device of FIG. 1 with removable and re-attachable windows being removed from the device. FIG. 5 shows a perspective view of the patient rotating device of FIG. 2. Here one can see that the windows 32 and 34 are removable and re-attachable from the the middle region 30 of the device. The middle region, as such, in embodiments of the disclosed technology, has a side which is covered with removable fastening devices such as hook and loop fasteners and/or spaced apart connectors. This can include a rectangular of material, two rectangles, or multiple rectangles of material which are adjacent to or overlap with each other. The windows 32 and 34 can be rectangular and adjacent to one another when attached on respective portions of a middle region 30 of the device. The windows can then cover a contiguous area of a patient or the device and be removed one at a time or at the same time allowing access to a patient (or any object) there-under.

Figure 6:
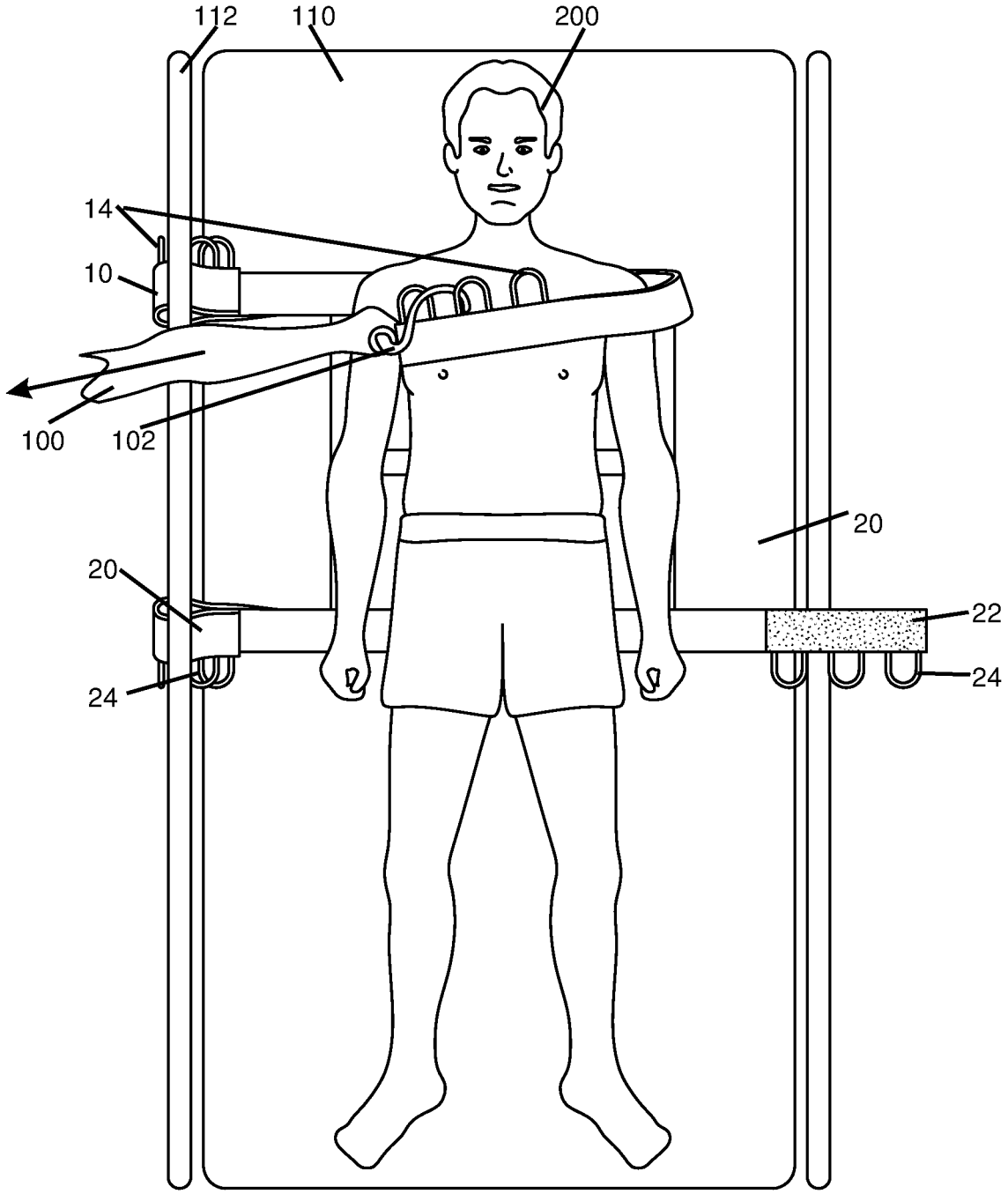
FIG. 6 shows a patient rotating device connected on a first end to a bed rail in use with a patient lying thereon in an embodiment of the disclosed technology.

FIG. 6 shows a patient rotating device connected on a first end to a bed rail in use with a patient lying thereon in an embodiment of the disclosed technology. Here, a patient 200 is lying flat on the turning device, on his back. The turning device is attached to bed rails 112 of a bed 110. The bed rail or bed rails are devices which hold securely relative to a bed and extend at least partially along a length of the bed. The bed rails can be fixedly attached to a bed platform or part of the bed or kept securely next to a bed. "Secure" in this disclosure is defined as "remains in place or substantially in place while turning a patient with devices of the disclosed technology." With the horizontal straps 10 and 20 attached to a bed rail 112 at one end (each) thereof, the straps are held in place at the one end while the patient is turned. This is achieved by pulling another end of each strap 10 and 20 over the patient 200 so the patient is wrapped by the straps on a bottom, top, and one side. A rope 102 or other device can be attached to hooks 14/24 of a strap to aid in pulling the person. The hooks 14/24 must be securely attached to the respective strap 10/20. Multiple or all straps 10/20 can be pulled in this manner in sequence or simultaneously to turn the patient.

Figure 7:
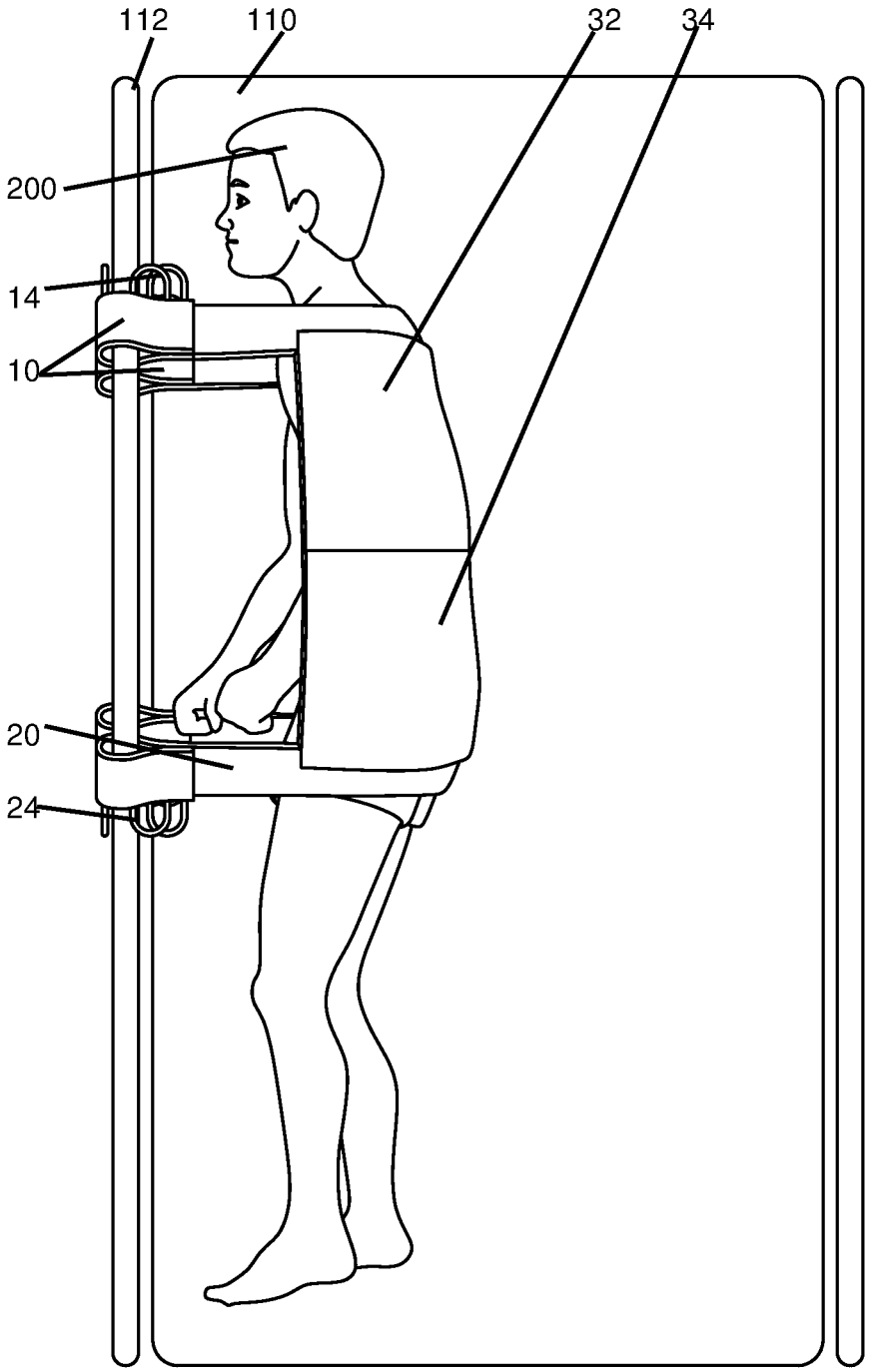
FIG. 7 shows the patient rotating device of FIG. 6 with the patient rotated to the side and both ends thereof attached to a bed rail in an embodiment of the disclosed technology.

FIG. 7 shows the patient rotating device of FIG. 6 with the patient rotated to the side and both ends thereof attached to a bed rail in an embodiment of the disclosed technology. Here, the patient has been turned by pulled the second ends of each strap 10 and 20 and attaching them to the bed rail 112, such as by wrapping the second ends of each strap around the bed rail or rails 112 and then attaching the straps 10 and 20 back onto themselves. The patient is now turned, the turning supported by the panels or windows 32 and 34 which cover the patient between the straps 10 and 20. Note that end regions of each strap are defined as ending where the covers or middle region 30 attaches to the straps in embodiments of the disclosed technology.

Figure 8:
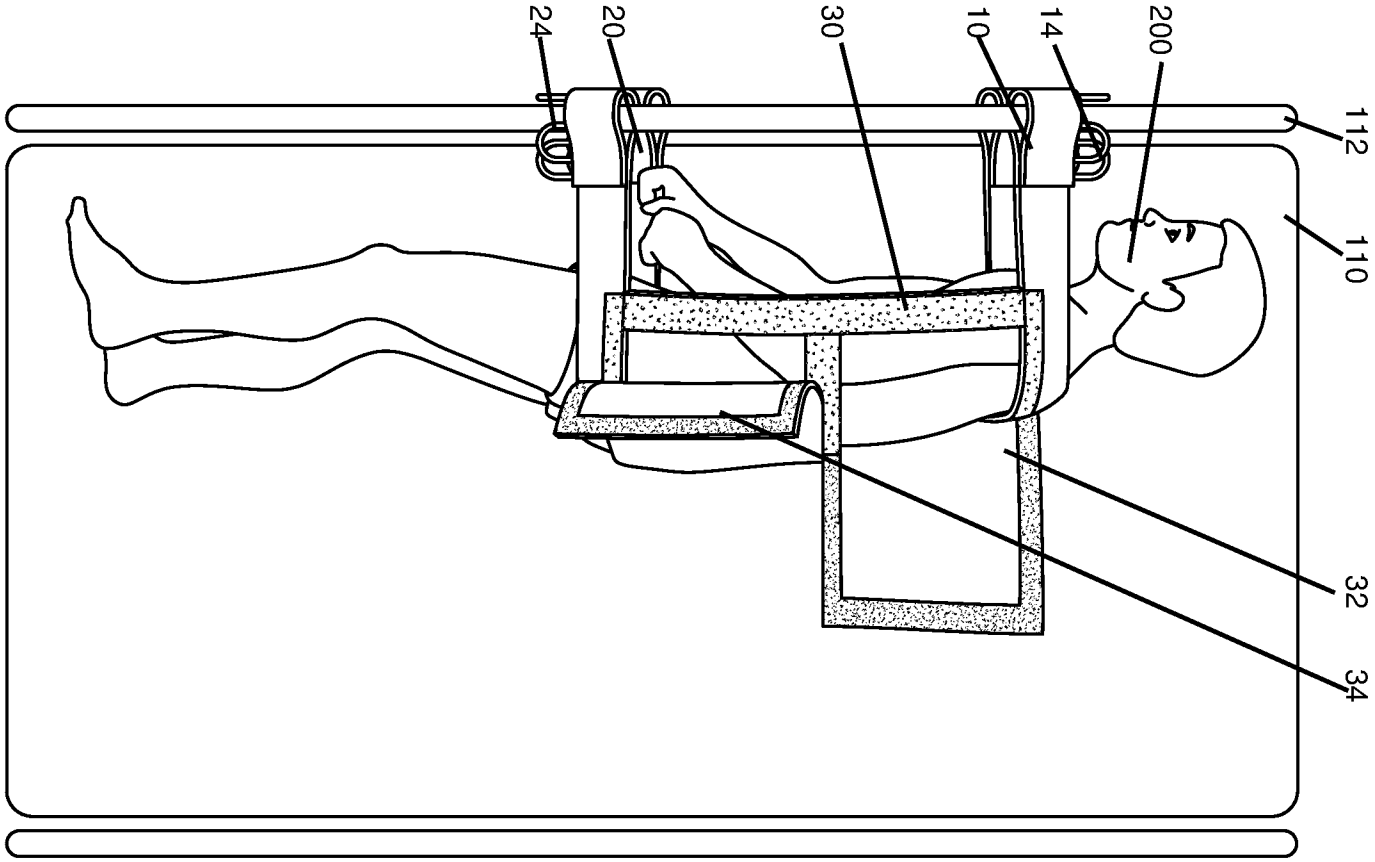
FIG. 8 shows a version of the patient rotating device of FIG. 7 with the removable and re-attachable windows in a removed and partially removed state, respectively.
Figure 9:
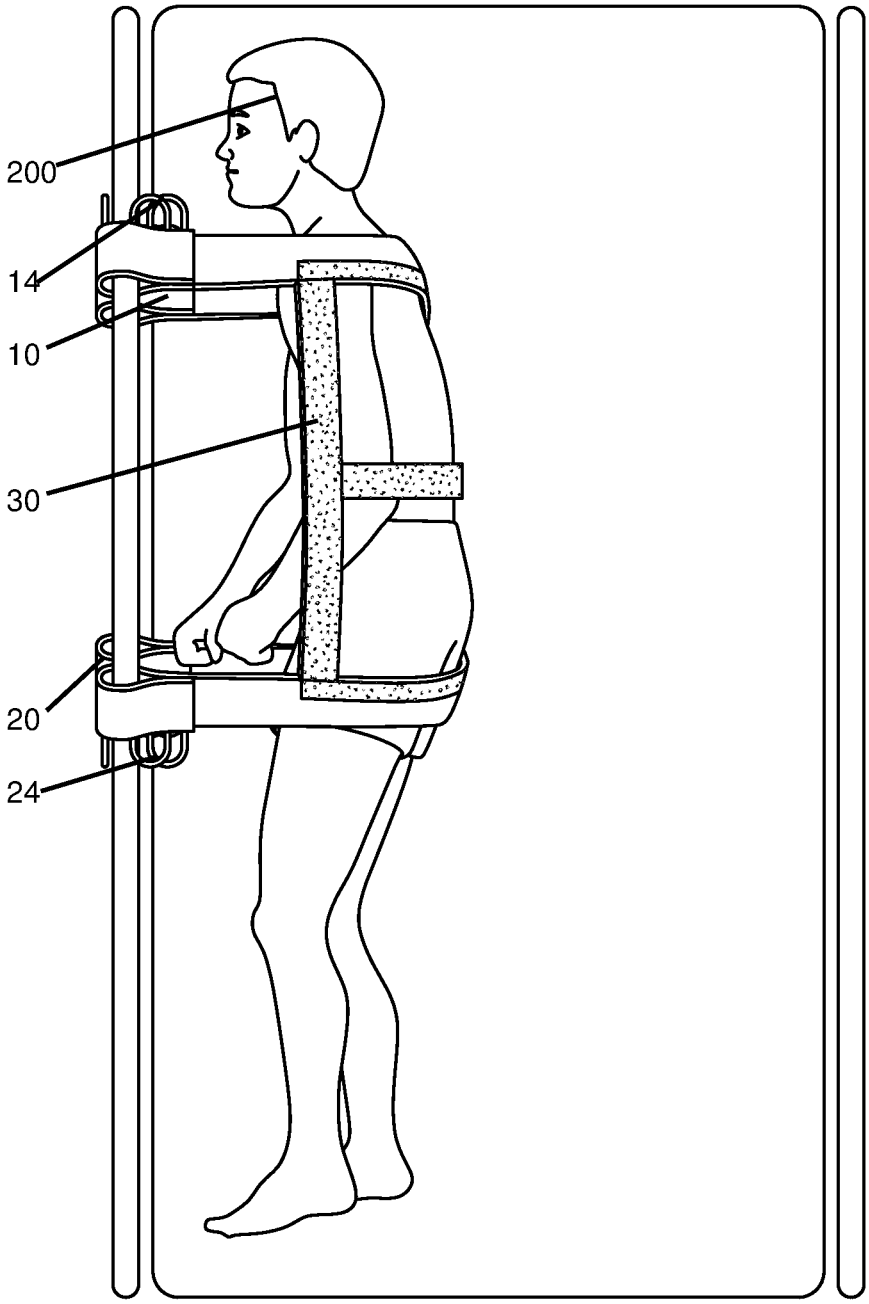
FIG. 9 shows a version of the patient rotating device of FIG. 7 with the removable and re-attachable windows in a fully removed state.

FIG. 8 shows a version of the patient rotating device of FIG. 7 with the removable and re-attachable windows in a removed and partially removed state, respectively. FIG. 9 shows a version of the patient rotating device of FIG. 7 with the removable and re-attachable windows in a fully removed state. The windows 32 has been completely disconnected from the middle region 30 of the device for purposes of showing same. Note that each window 32 and 34 can have an attachment mechanism around edges of a most flat and elongated planar side thereof. A portion between the attachment mechanism (or connector) lacks such a connector and is a fabric lacking abrupt or large abrasiveness according to an ordinary observer. This allows burns or the like to be treated with care by keeping only soft fabric or the like at such regions of a patient, as well as allowing for access thereto by removing the panels after the patient has been turned all the while protecting the patient with such a cover while the patient is lying down or being turned. Here, the panel or window 34 is shown partially removed and partially attached.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A patient rotating device comprising:

two parallel straps each including a first end, a second end, and a flat upper surface, said first ends opposite said second ends, each of said first ends and said second ends including a connector;

two vertical straps connected to said two parallel straps, said two vertical straps orthogonal relative to said two parallel straps and parallel relative to each other, said two vertical straps terminating at said two parallel straps, said two vertical straps defining a rectangular middle section between said two parallel straps, said rectangular middle section including a window and a panel, said window defining a portal for providing access to said patient, said panel removably attachable to said window to cover said portal;

wherein said rectangular middle section is disposed inward of said first ends and second ends such that said two vertical straps are connected to an area of said two parallel straps disposed between said connectors;

wherein each said connector comprises hook and loop fastening material adapted to removably connect to another connector of a same respective said parallel strap;

wherein each said connector further comprises a plurality of hooks extending orthogonally outwardly relative to the respective parallel strap on which said connector is disposed, said plurality of hooks coplanar relative to said respective parallel strap.

2. The device of claim 1, wherein said window comprises two windows in parallel to each other.

3. The device of claim 2, wherein said rectangular middle section is bifurcated by a horizontal middle strap extending in parallel with said two parallel straps, said horizontal middle strap connecting said two vertical straps and defining said two windows.

4. The device of claim 3, wherein said two vertical straps each have a side which is covered in hook and loop fastening material, and wherein each of said two parallel straps, has a portion, between said two vertical straps, which is covered in said hook and loop fastening material.

5. The device of claim 4, wherein said panel comprises two separate and distinct panels each attachable to a respective window of said two windows.

6. The device of claim 5, wherein each panel has a rectangle of hook and loop fastener extending around a perimeter of said panel, on a most elongated planar side thereof.

7. The device of claim 6, wherein said two opposing sides of said rectangle of hook and loop fastener of each said panel correspond in shape, size, and position to substantially half of said hook and loop fastener of said two vertical straps.

8. The device of claim 1, wherein each strap of said two parallel straps comprises a portion which is connected to said rectangular middle section and spaced apart from each said connector of each said strap.

9. The device of claim 8, wherein each said connector is disposed on said flat upper surface of said respective parallel strap and is coextensive with the respective end on which it is disposed.

10. The device of claim 1, wherein a rope is attached to at least one hook of said plurality of hooks, said rope and said at least one hook adapted to be used to turn a patient sideways.

11. The device of claim 10, wherein each said connector of each said parallel strap is attached to a bed rail.

12. A method of using the device of claim 5, comprising:

connecting said two parallel straps to a bed rail via a first said connector of each said strap;

laying an object on said two parallel straps and said rectangular middle section;

pulling a second connector of each said connector closer to said bed rail until said object is turned about 90 degrees;

attaching each said second connector to said bed rail or a second bed rail on a same side of said bed as a first said bed rail.

13. The method of claim 12, wherein said object is a person.

14. The method of claim 12, further comprising a step of at least partially removing only one of said panels while leaving another of said panels covering a part of said object.

15. The device of claim 1, wherein said two parallel straps and said two vertical straps define a perimeter of said rectangular middle section and a perimeter of said window.

16. A patient rotating device comprising:

a rectangular window formed of two parallel straps and two vertical straps, said two vertical straps arranged orthogonally to the two parallel straps, being parallel to one another, and terminating at said two parallel straps, each of said two parallel straps and two vertical straps having a flat upper surface including one portion of a hook-and-loop fastener;

four extension straps, each extension strap having:

a flat upper surface;

one end connected to an end of one of said parallel straps; and an opposing end including a connector; and a rectangular panel having a corresponding portion of the hook-and-loop fastener disposed along a perimeter thereof, said rectangular panel adapted to reversibly connect to said rectangular window by said hook-and-loop fastener;

wherein each said connector comprises hook and loop fastening material adapted to removably connect to another connector of a same respective extension strap;

wherein each said connector further comprises a plurality of hooks extending orthogonally outwardly relative to the respective parallel strap on which said connector is disposed, said plurality of hooks coplanar relative to said respective parallel strap.

17. The device of claim 16, wherein:

said rectangular window is bifurcated into two windows in parallel to each other, by a horizontal strap extending in parallel to and between said two parallel straps and connected to said two vertical straps, orthogonally thereto; and wherein said panel comprises two separate and distinct panels each attachable to a respective window of said two windows.

* * * * *